United States Patent [19]

Garcia et al.

[11] 4,140,555

[45] Feb. 20, 1979

[54] NICKEL-BASE CASTING SUPERALLOYS

[75] Inventors: Willard Garcia; Jerry A. Butzer, both of La Porte, Ind.; John R. Mihalisin, North Caldwell; Gerald W. Hulit, Ridgewood, both of N.J.

[73] Assignee: Howmet Corporation, Greenwich, Conn.

[21] Appl. No.: 849,352

[22] Filed: Nov. 7, 1977

Related U.S. Application Data

[63] Continuation of Ser. No. 644,853, Dec. 29, 1975, abandoned.

[51] Int. Cl.[2] ..... C22C 19/05

[52] U.S. Cl. ..... 148/32; 75/171; 148/32.5

[58] Field of Search ..... 75/171, 170; 148/32, 148/32.5

[56] References Cited

U.S. PATENT DOCUMENTS

| | | | |
|---|---|---|---|
| 2,570,193 | 10/1951 | Bieber et al. | 75/171 |
| 3,512,963 | 5/1970 | Schramm et al. | 75/171 |
| 3,575,734 | 4/1971 | Muzyka et al. | 75/171 |
| 3,723,108 | 3/1973 | Twigg et al. | 75/171 |

*Primary Examiner*—R. Dean

*Attorney, Agent, or Firm*—Pennie & Edmonds

[57] ABSTRACT

A nickel-base casting superalloy consisting essentially (by weight of the alloy) of 7% to 25% chromium, 02.% to 7% aluminum, 0.2% to 6% titanium, 0.01% to 0.25% carbon, up to 0.2% zirconium, up to 0.15% boron, up to 3% hafnium, at least 5% of a matrix-strengthening element selected from the group consisting of 0 to 25% cobalt, 0 to 10% molybdenum, 0 to 13% tungsten to 6% tantalum, 0 to 5% columbium, and 0 to 1.5% vanadium, a carbide shape controller selected from 0.022% to 0.15% magnesium, 0.005% to 0.1% calcium, or mixtures thereof, and the balance nickel except for impurties, said alloy in the as-cast condition having a fine grain macrostructure in thick as well as thin sections, exhibiting a microstructure having precipitated carbide particles which are substantially equi-axed in shape and well-distributed through the alloy with a substantial portion of the magnesium and/or calcium content of the alloy concentrated in such particles and at grain boundaries, and displaying in its thick sections a tensile strength and elongation substantially higher than a corresponding thick-section alloy having a microstructure exhibiting script-like carbide particles substantially free internally and at grain boundaries of said carbide shape controller.

10 Claims, No Drawings

NICKEL-BASE CASTING SUPERALLOYS

This is a continuation of application Ser. No. 644,853, filed Dec. 29, 1975, abandoned.

BACKGROUND OF THE INVENTION

The nickel-base casting superalloys are a varied group of high temperature alloys having austenitic structures and are used to make cast articles, such as turbine wheels, which must exhibit high mechanical properties at high temperatures. While generally suitable for such purposes, the heretofore known nickel-base casting superalloys are not capable of producing castings having high tensile strength and ductility and a fine grain size in both the thick and thin sections of the castings. Carbide particles in many such alloys are generally script-like, that is, they resemble the elongated lines of script characters.

SUMMARY OF THE INVENTION

Novel nickel-base superalloys have now been found which can be cast into castings having improved tensile strength and ductility in thick sections and a fine grain in thick as well as thin sections. These increases in strength and ductility are obtained in the as-cast condition, without need for subsequent heat treatment and without any changes in casting parameters. However, the new alloys may be heat treated when such is desired.

Briefly, the present invention comprises nickel-base casting alloys consisting essentially (by weight of the alloy) of 7% to 25% chromium, 0.2% to 7% aluminum, 0.2% to 6% titanium, 0.1% to 0.25% carbon, up to 0.2% zirconium, up to 0.15% boron, up to 3% hafnium, at least 5% of a matrix-strengthening element selected from the group consisting of 0 to 25% cobalt, 0 to 10% molybdenum, 0 to 13% tungsten, 0 to 6% tantalum, 0 to 5% columbium, and 0 to 1.5% vanadium, a carbide shape controller selected from 0.022% to 0.15% magnesium, 0.005% to 0.1% calcium, and mixtures thereof, and the balance nickel except for impurities, which generally aggregate less than 0.2%. The new alloy in the as-cast condition has a fine grain macrostructure in thick as well as thin sections, and exhibits a microstructure having primary carbide particles which are substantially equi-axed (i.e. blocky or angular) in shape and well-distributed through the alloy, with a substantial portion of the magnesium and/or calcium content of the alloy concentrated in such particles and at grain boundaries. The as-cast alloy displays in its thick sections a tensile strength and elongation substantially higher than corresponding thick-section alloys having a microstructure exhibiting script-like carbide particles substantially free internally and at grain boundaries of said carbide shape controller.

DETAILED DESCRIPTION

The alloys of the present invention are prepared by melting under vacuum quantities of each of the metals involved to give alloys having the following composition:

| Metal | % by Weight of the Alloy | | |
|---|---|---|---|
| Chromium | 7. | - | 25 |
| Aluminum | 0.2 | - | 7 |
| Titanium | 0.2 | - | 6 |
| Carbon | 0.01 | - | 0.25 |

-continued

| Metal | % by Weight of the Alloy | | |
|---|---|---|---|
| Zirconium | 0 | - | 0.2 |
| Boron | 0 | - | 0.15 |
| Hafnium | 0 | - | 3 |
| Cobalt | 0 | - | 25 |
| Molybdenum | 0 | - | 10 |
| Tungsten | 0 | - | 13 |
| Tantalum | 0 | - | 6 |
| Columbium | 0 | - | 5 |
| Vanadium | 0 | - | 1.5 |
| Nickel (plus impurities) | Balance | | |

The alloy contains at least 5% by weight of cobalt, molybdenum, tungsten, tantalum, columbium, and/or vanadium. The alloys may be prepared in whole from virgin metal, or from major amounts of revert to which amounts of virgin metal are added as required for composition adjustment and to make up the desired weight of alloy. The alloys are prepared in accordance with conventional practice by melting virgin metal elements (or nickel master alloys thereof) and/or revert (with virgin element corrections if necessary) under vacuum in an induction melting furnace. The charge material is melted and refined as necessary in conformity with normal commercial practice.

The melt is prepared as essentially oxygen-free and sulfur-free metal, by use of charge components that are themselves essentially free of these impurities. To the extent that very small proportions of oxygen or sulfur may be included in the charge, they are eliminated by the deoxidizing and desulfurizing effect of such constituents as aluminum, titanium, zirconium, and boron. With materials available today for forming the casting alloys, the oxygen level does not ordinarily exceed 0.005% by weight of the melt and the sulfur 0.008% by weight. At such levels there is no need to deoxidize or desulfurize.

When the melt is at or has been brought to the proper oxygen-free and sulfur-free composition and to the desired temperature, the carbide shape controller, magnesium and/or calcium, is added in an amount sufficient to insure retention of the magnesium and/or calcium in the alloy at the necessary levels after casting and solidification. In the case of magnesium from 0.022% to 0.15% and in the case of calcium from 0.0005% to 0.1% (by weight of the alloy) must be retained in the alloy to obtain the desired properties in the casting. The magnesium is preferably added in the form of a nickel magnesium master alloy containing about 5% by weight magnesium. The calcium can be added in the form of lime or a nickel calcium master alloy.

After introduction and dispersion of the carbide shape controller into the melt, the melt can be cast into the shape desired using any conventional molds and casting techniques, such as vacuum casting into metallic ingot molds for remelt stock or directly into ceramic molds of the desired shape.

When remelting ingots produced as above for the pouring of castings, it is desirable to melt and pour as quickly as possible in order to minimize the loss of calcium and/or magnesium since these elements are rapidly vaporized at normal temperatures under vacuum.

It is recognized that magnesium has been used as a deoxidizer and desulfurizer in nickel-base casting superalloys and that lime has been added to reduce sulfur content. In both instances, however, the amounts retained as a residual in the alloys are insignificant. U.S. Pat. No. 3,850,624 to Hulit et al. directed to the method of making nickel-base superalloys, discloses adding sufficient magnesium to such alloys to insure retention of 0.001 to 0.02% magnesium therein after casting and solidification. The purpose of such magnesium addition is to minimize the tendency of the alloy in the molten state to set and, upon solidification, to adhere to a refractory vessel. The patentees state that there is no significant correlation between the amount of retained magnesium in the ingots cast from a given melt, and the non-wetting character of such ingots relative to refractory surfaces with levels of retained magnesium as low as 0.001% being suitable for their purposes. This is to be contrasted with the instant invention where there must be at least 0.022% retained magnesium in the melt when cast.

The invention will be further described in connection with the following examples which are set forth for purposes of illustration.

EXAMPLE I

An alloy having the following composition was prepared by melting under vacuum the appropriate quantity of each metal:

| Metal | % by Weight of the Alloy |
|---|---|
| Chromium | 12.59 |
| Aluminum | 5.86 |
| Titanium | 0.78 |
| Carbon | 0.053 |
| Zirconium | 0.08 |
| Boron | 0.01 |
| Cobalt | 0.25 |
| Molybdenum | 4.21 |
| Columbium plus Tantalum | 2.13 |
| Magnesium | 0.0245 |
| Nickel (plus impurities) | Balance |

The magnesium was added to the alloy melt as a nickel magnesium alloy when the melt had reached casting temperature, and after being throughly admixed into the melt, the melt was cast in vacuum into a chilled metallic ingot mold.

The ingots were melted in a remelt furnace and cast in ceramic molds into turbine wheels.

The room temperature tensile properties of hub axial (thick section) specimens taken from ten of the cast wheels were then measured using standard testing techniques. The results of such testing are set forth below. As a comparison there is set forth the average tensile property test results for corresponding specimens from 100 turbine wheels previously cast from melts with as close as possible chemistries save that they did not contain the level of magnesium of the instant alloy.

| Casting | Ultimate Ksi | 2% Yield Ksi | Elongation % |
|---|---|---|---|
| 1 | 150 | 100 | 19.5 |
| 2 | 130 | 99 | 20.4 |
| 3 | 137 | 99 | 23.5 |
| 4 | 138 | 102 | 17.5 |
| 5 | 140 | 101 | 21.9 |
| 6 | 130 | 98 | 19.8 |
| 7 | 141 | 101 | 22.1 |
| 8 | 134 | 99 | 20.6 |
| 9 | 132 | 98 | 23.0 |
| 10 | 129 | 100 | 16.4 |
| Average of Castings 1–10 | 134 | 99.7 | 20.5 |
| Average* | 117.4 | 97.8 | 12.7 |

*100 prior castings without magnesium level of present invention

The tensile ultimate average of wheels made with the alloy of the present invention was substantially 17,000 psi higher than that of the average of alloys without the instant magnesium levels coupled with a greater than 60% increase in elongation.

In addition, the wheels cast with the alloys of the present invention had a fine grain size both internally and on the surface in both the thin and thick sections of the wheel. The grain size of the thick hub section was substantially finer than that found in wheels without the addition of carbide shape controller.

Lastly, the shape of the carbides formed in the wheels cast from the alloys of the present invention was not of the normal script type found in regular heats. Rather, the carbides were approximately equi-axed (or blocky) in shape and well-distributed throughout the casting, with a substantial portion of the magnesium concentrated in such particles and at the grain boundaries.

EXAMPLE II

An alloy having the following analysis was melted under vacuum:

| Metal | % by Weight of the Alloy |
|---|---|
| Chromium | 12.16 |
| Aluminum | 5.89 |
| Titanium | 0.72 |
| Carbon | 0.063 |
| Zirconium | 0.07 |
| Boron | 0.007 |
| Cobalt | 0.05 |
| Molybdenum | 4.13 |
| Columbium plus Tantalum | 2.16 |
| Calcium | 0.0052 |
| Magnesium | 0.0011 |
| Nickel (plus impurities) | Balance |

Magnesium was not purposely added but was present as a residual in the substantially oxygen-free and sulfur-free alloy ingots used in preparing the melt. Calcium was added as calcium-nickel master alloy. The alloy was cast in vacuum into the form of a turbine wheel. Upon cooling the thick hub section of the wheel displayed a significantly finer grain than wheels cast from the same alloy to which no calcium had been added. The microstructure of this alloy displayed carbide particles which for the most part were blocky or globular, and was substantially free of the script-like carbide particles which characterized wheels cast from the same alloy without the calcium addition.

Hub axial test bars from the thick hub sections of wheels cast from the alloy with and without the calcium addition showed the following physical properties:

| | Without Ca Addition | | With Ca Addition | |
|---|---|---|---|---|
| | Bar No. 1 | Bar No. 2 | Bar No. 3 | Bar No. 4 |
| Ultimate Tensile Strength | 101 Ksi | 100 Ksi | 129 Ksi | 130 Ksi |
| 0.2% Yield Strength | 94 Ksi | 93 Ksi | 97 Ksi | 99 Ksi |
| Elongation | 12.3% | 11.1% | 15.4% | 21.3% |

Advantageous specific alloy composition ranges, within the broad range stated above, includes the following (in percent by weight of the alloy):

| | A | | | B | | | C | | |
|---|---|---|---|---|---|---|---|---|---|
| Chrominum | 11. | - | 13. | 13. | - | 15. | 8. | - | 10. |
| Aluminum | 5.5 | - | 6.2 | 5.5 | - | 6.5 | 5.3 | - | 5.7 |
| Titanium | 0.5 | - | 0.8 | 0.75 | - | 1.25 | 1.3 | - | 1.7 |
| Carbon | 0.05 | - | 0.07 | 0.08 | - | 0.16 | 0.13 | - | 0.17 |
| Zirconium | 0.05 | - | 0.15 | 0.05 | - | 0.015 | 0.03 | - | 0.08 |
| Boron | 0.005 | - | 0.015 | 0.005 | - | 0.015 | 0.01 | - | 0.02 |
| Cobalt | 0 | - | 1. | 0 | - | 1.0 | 9. | - | 11. |
| Molybdenum | 3.8 | - | 4.5 | 3.8 | - | 5.2 | 2.3 | - | 2.7 |
| Tungsten | | - | | | - | | 9. | - | 11. |
| Columbium plus tantalum | 1.8 | - | 2.3 | 1.8 | - | 2.5 | | - | |
| Tantalum | | - | | | - | | 1.3 | - | 1.7 |
| Magnesium | 0.022 | - | 0.15 | 0.022 | - | 0.15 | 0.022 | - | 0.15 |
| Nickel | | balance | | | balance | | | balance | |

The magnesium in these alloys may of course be supplemented or replaced by 0.005% to 0.010% calcium in accordance with the invention.

While the invention has been described in connection with preferred embodiments, it is not intended to limit the invention to the particular form set forth, but on the contrary, it is intended to cover such alternatives, modifications and equivalents as may be included within the spirit and scope of the invention as defined by the appended claims.

What is claimed is:

1. A nickel-base casting superalloy consisting (by weight of the alloy) of 7% to 25% chromium, 0.2% to 7% aluminum, 0.2% to 6% titanium, 0.01% to 0.25% carbon, up to 0.2% zirconium, up to 0.15% boron, up to 3% hafnium, at least 5% of a matrix-strengthening element selected from the group consisting of 0 to 25% cobalt, 0 to 10% molybdenum, 0 to 13% tungsten, 0 to 6% tantalum, 0 to 5% columbium, and 0 to 1.5% vanadium, a carbide shape controller selected from 0.022% to 0.15% magnesium, 0.005% to 0.1% calcium, or mixtures thereof, and the balance nickel except for impurities said alloy in the as-cast condition having a fine grain macrostructure in thick as well as thin sections, exhibiting a microstructure having precipitated carbide particles which are substantially equi-axed in shape and well-distributed through the alloy with a substantial portion of the carbide shape controller content of the alloy concentrated in such particles and at grain boundaries, and displaying in its thick sections a tensile strength and elongation substantially higher than a corresponding thick-section alloy having a microstructure exhibiting script-like carbide particles substantially free internally and at grain boundaries of said carbide shape controller.

2. The superalloy of claim 1 in which the carbide shape controller is magnesium.

3. The superalloy of claim 1 in which the carbide shape controller is calcium.

4. The superalloy of claim 1 in which the carbide shape controller is a combination of magnesium and calcium.

5. A nickel-base casting superalloy consisting of, by weight of the alloy, 11% to 13% chromium, 5.5% to 6.2% aluminum, 0.5% to 0.8% titanium, 0.05% to 0.07% carbon, 0.05% to 0.15% zirconium, 0.005% to 0.015% boron, up to 1% cobalt, 3.8% to 4.5% molybdenum, 1.8% to 2.3% tantalum plus columbium, and 0.022% to 0.15% magnesium and the balance nickel, said alloy in the as-cast condition having a fine grain macrostructure in thick as well as thin sections, exhibiting a microstructure having precipitated carbide particles which are substantially equi-axed in shape and well-distributed through the alloy with a substantial portion of the magnesium content of the alloy contentrated in such particles and at grain boundaries, and displaying in its thick sections a tensile strength and elongation substantially higher than a corresponding thick-section alloy having a microstructure exhibiting script-like carbide particles substantially free internally and at grain boundaries of said magnesium.

6. A nickel-base casting superalloy consisting of, by weight of the alloy, 13% to 15% chromium, 5.5% to 6.5% aluminum, 0.75% to 1.25% titanium, 0.08% to 0.016% carbon, 0.05% to 0.015% zirconium, 0.005% to 0.015% boron, up to 1% cobalt, molybdenum, 1.8% to 2.5% tantalum plus columbium, 0.022% to 0.15% magnesium, and the balance nickel, said alloy in the as-cast condition having a fine grain macrostructure in thick as well as thin sections, exhibiting a microstructure having precipitated carbide particles which are substantially equi-axed in shape and well-distributed through alloy with a substantial portion of the magnesium content of the alloy concentrated in such particles and at grain boundaries, and displaying in its thick sections a tensile strength and elongation substantially higher than a corresponding thick-section alloy having a microstructure exhibiting script-like carbide particles substantially free internally and at grain boundaries of said magnesium.

7. A nickel-base casting superalloy consisting of, by weight of the alloy, 8% to 10% chromium, 5.3% to 5.7% aluminum, 1.3% to 1.7% titanium, 0.13% to 0.17% carbon, 0.03% to 0.08% zirconium, 0.01% to 0.02% boron, 9 to 11% cobalt, 2.3% to 2.7% malybdenum, 9% to 11% tungsten, 1.3% to 1.7% tantalum, 0.022% to 0.022% to 0.15% magnesium, and the balance nickel, said alloy in the as-cast condition having a fine grain macrostructure in thick as well as thin sections, exhibiting a microstructure having precipitated carbide particles which are substantially equi-axed in shape and well-distributed through the alloy with a substantial portion of the magnesium content of the alloy concentrated in such particles and at grain boundaries, and in displaying in its thick sections a tensile strength and elongation substantially higher than a corresponding thick-section alloy having a microstructure exhibiting script-like carbide particles substantially free internally and at grain boundaries of said magnesium.

8. The superalloy of claim 5 in which the magnesium is replaced at least in part by 0.005% to 0.1% calcium.

9. The superalloy of claim 6 in which the magnesium is replaced at least in part by 0.005% to 0.1% calcium.

10. The superalloy of claim 7 in which the magnesium is replaced at least in part by 0.005% to 0.1% calcium.

* * * * *

UNITED STATES PATENT AND TRADEMARK OFFICE

CERTIFICATE OF CORRECTION

PATENT NO. : 4,140,555

DATED : February 20, 1979

INVENTOR(S) : Willard Garcia; Jerry A. Butzer, John Mihalisin and Gerald W. Hulit It is certified that error appears in the above-identified patent and that said Letters Patent are hereby corrected as shown below:

Abstract - line 2, "02.%" should read --0.2%--

Abstract - line 7, "tungsten to 6%" should read

--tungsten, 0 to 6%--

Column 6, lines 45-46, claim 7, "malybdenum" should read

--molybdenum--

Column 6, line 47, claim 7, "0.022% to" is repeated

Signed and Sealed this

*Third* Day of *July 1979*

[SEAL]

*Attest:*

*Attesting Officer*

LUTRELLE F. PARKER

*Acting Commissioner of Patents and Trademarks*